US005507685A

United States Patent [19]

Hoffman

[11] Patent Number: 5,507,685

[45] **Date of Patent: *Apr. 16, 1996**

[54] METHOD FOR SURFACE FINISHING OF DIFFICULT POLISH SURFACES

[76] Inventor: Steve E. Hoffman, 6 Maple St., Englewood Cliffs, N.J. 07632

[ * ] Notice: The term of this patent shall not extend beyond the expiration date of Pat. No. 5,140,783.

[21] Appl. No.: 112,244

[22] Filed: Aug. 25, 1993

[51] Int. Cl.[6] ..... B24B 31/06

[52] U.S. Cl. ..... 451/34; 451/330; 134/7

[58] Field of Search ..... 451/34, 35, 32, 451/37, 330, 113, 104; 134/7

[56] References Cited

U.S. PATENT DOCUMENTS

| | | | |
|---|---|---|---|
| 1,352,598 | 9/1920 | Hart | 451/330 |
| 2,185,262 | 1/1940 | Lupo, Jr. | 451/33 |
| 2,440,656 | 4/1948 | Huntington | 451/330 |
| 2,545,291 | 3/1951 | Lupo | 451/330 |
| 3,453,782 | 7/1969 | Hagelüken et al. | 451/330 |
| 3,504,124 | 3/1970 | Kittredge et al. | 451/33 |
| 5,140,783 | 8/1992 | Hoffman | 451/32 |

OTHER PUBLICATIONS

Davidson, "Developing quality surfaces with dry process mass finishing", The Fabricator, Dec. 1988, (4 pages).

*Primary Examiner*—Robert A. Rose
*Attorney, Agent, or Firm*—Curtis, Morris & Safford

[57] ABSTRACT

A method for finishing a surface of a workpiece, having the steps of agitating the workpiece with a first mixture including a first plurality of discrete, homogeneous compressed felt chunks having a first particulate abrasive coating thereon, and then agitating the workpiece with a second mixture including a second plurality of discrete, homogeneous compressed felt chunks having a second particulate abrasive coating thereon with an abrasive size smaller than an abrasive size of the first particulate abrasive coating.

7 Claims, 3 Drawing Sheets

METHOD FOR SURFACE FINISHING OF DIFFICULT POLISH SURFACES

BACKGROUND OF THE INVENTION

The present invention relates generally to finishing of the surfaces of workpieces, and more particularly is directed to the use of finishing media loaded into a barrel with the workpieces.

Finishing the surface of a workpiece usually involves polishing and abrading. Abrasion refers to the removal of larger portions of the surface, primarily to alter the overall contour of the surface. Abrasion is often performed in a wet process for a grinding, deburring, aggressive smoothing or other material removal operation. Polishing refers to the removal of small portions of the surface of a workpiece, in a scratchlike manner, primarily to alter the visible finish. Polishing is often performed in a dry process, resulting in surfaces with reflectivity approaching the quality obtained from manual buffing. Usually, automatic polishing is accompanied by at least a small amount of abrasion due to the manner in which it is performed.

Methods for automatically finishing the surface of workpieces employ a tub into which workpieces and finishing media are loaded. The tub is moved to impart motion to its contents, and the resulting contacts between the media and workpieces remove portions of the surfaces of the workpieces. Automatic finishing methods include rotary barrel finishing, vibratory barrel finishing, centrifugal barrel finishing and centrifugal disk finishing.

Rotary barrel finishing relies on gravitational forces. During rotation, the contents of the barrel move upwards until gravity causes the contents to slide downwards. The majority of the finishing occurs when the contents slide down. The contacts between the media and workpieces tend to be long scratches similar to those obtained using a buffing wheel. This technique is good for smoothing sharp exterior edges and corners (radiusing), but is not particularly effective for inside surfaces.

Vibratory barrel finishing relies on kinetic energy. A vibratory motion is imparted to the contents of the barrel. The finishing occurs during the short strokes of contact between the media and workpieces. This technique is reasonably good for polishing interior surfaces but is not particularly effective for corner or edge finishing. Also, vibratory finishing does not produce a particularly refined finish.

Centrifugal barrel finishing relies on centrifugal pressure. The barrel is rotated while it revolves around an axis, exposing the contents of the barrel to high centrifugal forces. The finishing occurs when the media press on the workpieces. This technique is good for producing refined surfaces in short times. This technique is also appropriate when the identity of each workpiece must be maintained, as each workpiece may be loaded into one of several barrels which simultaneously rotate around their respective axis and revolve around a central axis.

Centrifugal disk finishing also relies on centrifugal pressure. Here, a containment vessel has a rotating disk as a base and a non-rotating cylindrical vertical wall. Media and workpieces are thrown against the wall and slide down. Finishing occurs both when the media press on the workpieces while they are pressed outward and during the downwards sliding. This technique is good for precision finishing in short times, but requires a large amount of monitoring.

Traditional finishing media include hardwood or resin preforms used with abrasive paste, and plastic or ceramic shapes with embedded abrasive. Substantial deterioration of the media occurs during finishing due to the abrasive action of the media upon itself, such as between two preforms or two media shapes. Typically, plastic finishing media lose their mass at a rate of about 3% per hour of use, and ceramic finishing media lose their mass at a rate of about 3–5% per hour of use. Thus, such media are not durable.

When the preforms or shapes impact the surface of a workpiece, a portion of the surface of the workpiece may be abraded or removed from the workpiece. Sometimes this is desirable, as when removing marks or radiusing. However, in some cases, a workpiece has been carefully brought to its present size and shape, and it is desirable only to polish the workpiece, that is, not to abrade or cut down its surface. With conventional media, if the finishing process is controlled so that media contacts do not abrade the workpiece surface, then the finishing intervals become very long, rendering the finishing process relatively expensive.

If the workpiece has an intricately contoured shape, its interior surfaces may not be adequately polished. For example, if the surface includes a U-shaped region, conventional media tends to abrade the tops of the U-shape, but not reach the surface of the bowl at the base of the U-shape.

The preforms or shapes may have tips. When a tip perpendicularly contacts a workpiece surface, the tip digs a pit in the surface of the workpiece. The finished surface has a scratch pattern of peaks and valleys which diffuse or diffract light, resulting in a dull, foggy, matte finish, quite unlike a bright, shiny, highly reflective finish that is often desired.

FIG. 1 shows a spherical workpiece 100 being finished by conventional media 105A, 105B, 105C. Media 105B is seen to be sliding along the surface of workpiece 100, creating a long scratch 110, which desirably finishes the surface of workpiece 100.

The workpiece 100 has a U-shaped socket 130. Media 105C is seen to be eroding the edges of the socket 130. It will be appreciated that even if one of the tips of media 105C entered into the socket, negligible finishing occurs, as it is not possible for the media to slide along the surface of socket 130.

A tip of media 105A contacts workpiece 100 normal to the surface thereof and digs a small pit 120. In FIG. 1, pit 120 is enlarged for ease of illustration. During finishing, the surface of workpiece 100 becomes undesirably pitted.

A portion 150 of the surface of workpiece 100 is shown enlarged. The surface contains pits 151 and long scratches 152, corresponding to the action of media 105A and 105B, respectively.

It is expected that certain abrasives will break down during a finishing interval, so that the finishing interval begins with coarse abrading and concludes with finer polishing. However, this type of finishing cannot be precisely controlled. Furthermore, this type of finishing is not linear with time, that is, during a six day polish interval, the finishing during an hour of the first day is substantially different than during an hour of the sixth day.

Workpieces may be sensitive to the size of abrasive used in a finishing process. Specifically, a certain range of abrasive size may cause skin fractures perpendicular to the surface of a workpiece, giving the workpiece an undesirable shattered look. During the remainder of the finishing interval, the workpiece surface must be abraded sufficiently to remove these fractures, lengthening the finishing interval and changing the size of the workpiece. Alternatively, the finishing process must be controlled so as to remove abrasives in the undesired size range.

Multiple step finishing processes which do not substantially rely on abrasive breakdown have been used for attaining smooth surface finishing of metallic articles or parts. Typically, a first step, abrasive cutdown, removes excess material and provides a coarse finish, while a second step, burnishing, provides a smooth finish and a third step, polishing, provides a finely polished surface. Sometimes a fourth step, waxing, is used to produce a surface with maximum reflectivity.

U.S. Pat. No. 2,185,262 (Lupo) describes a process for finishing metallic articles in a tumbling barrel including a first step of tumbling the articles with hard bony pellets, such as vegetable ivory chips, bone chips, synthetic resin chip or hard tree root chips, and a hard coarse abrasive, such as ground pumice, emery or carborundum of 180 to 200 mesh, to effect a cutting operation for removing tool, grinding or sand marks. In a second step, the articles are tumbled with hard bony pellets and a hard fine abrasive, such are pumice, emery or carborundum of 320 to 400 mesh to effect polishing, and, in a third step, the articles are tumbled with fibrous fragments, such as wood pegs, including a fine abrasive of 500 to 800 mesh to impart high luster to the metal articles.

The process described in Lupo has several drawbacks. The pellet and wood peg media are abraded during finishing. The workpieces are abraded during each step, that is, more surface portions are removed than minimally necessary for polishing. The fibrous fragments, namely, the wood pegs, are rigid enough to dig pits in the surface of the workpieces which may be, e.g., malleable metals. Complex surfaces are not uniformly polished. A finishing process takes a long time, since a rotary barrel is used.

U.S. Pat. No. 3,504,124 (Kittredge et al.) relates to a finishing process carried out in water in a vibratory barrel, using media having a hardness which depends on temperature. Articles to be finished and the media, comprising a rigid plastic binder with abrasives having average particle diameters below 15 microns such as alumina, quartz or silicon carbide, are loaded into vibratory equipment for a first finishing operation at low temperatures of about 35° to 50° F. The temperature of the water is increased to about 100° to 125° F. in a second finishing operation, which produces articles having a finish in the range of one to 5 microinches (0.025 to 0.13 microns). A third step of final polishing is indicated as necessary, but no particular way of performing this final polishing is provided.

The process described in Kittredge et al. has several drawbacks. Importantly, a final polishing step, such as manual polishing, is required. A water supply is necessary, including a way to control the water temperature in a range from very cold to warm. The finishing media are not durable. The workpieces are abraded during each step. Complex surfaces are not uniformly polished.

At present, there is no known method of finishing surfaces which can be accomplished in a short finishing interval, uses durable media, polishes workpieces with minimal abrasion, polishes complex surfaces, provides a lustrous and highly reflective surface, is easy to control and is linear with time.

OBJECTS AND SUMMARY OF THE INVENTION

Therefore, an object of the present invention is to provide a method for surface finishing which avoids the aforementioned disadvantages of the prior art.

Another object of the present invention is to provide a method for surface finishing with at least one of the following advantages: use of durable media, polishing of workpieces with minimal abrasion, finishing of complex surfaces, provision of a highly reflective surface, ease of control, linearity with time and short finishing interval.

In accordance with this invention, a method for finishing a surface of a workpiece, comprises the steps of: first agitating the workpiece with a first mixture including a first plurality of discrete, homogeneous compressed felt chunks having a first particulate abrasive coating thereon; and second agitating the workpiece with a second mixture including a second plurality of discrete, homogeneous compressed felt chunks having a second particulate abrasive coating thereon, the second particulate abrasive coating having an abrasive size smaller than an abrasive size of the first particulate abrasive coating.

The above, and other objects, features and advantages of the present invention will be apparent in the following detailed description of the preferred embodiments of the present invention when read in conjunction with the accompanying drawings in which corresponding parts are identified by the same reference numeral.

DETAILED DESCRIPTION OF THE PREFERRED EMBODIMENTS

The present invention is a multiple step method for surface finishing of workpieces which are difficult to satisfactorily finish using conventional media and conventional finishing techniques.

The present invention uses, as finishing media, compressed felt chunks coated with abrasive, as described in U.S. Pat. No. 5,140,783, having a common inventor with the present invention, the disclosure of which is incorporated by reference herein. These compressed felt chunks will now be described in connection with FIG. 2, which shows a workpiece 200 being finished by abrasive coated compressed felt chunks 205A, 205B, 205C.

Each felt chunk is about 1 inch in at least one dimension, and may be a cube, pyramid, triangular or other shape. The compressed felt has a density of about 20 to 45 lbs. per cubic foot in the dry condition. The abrasive coated compressed felt chunks are inexpensive to manufacture.

Figure 3:
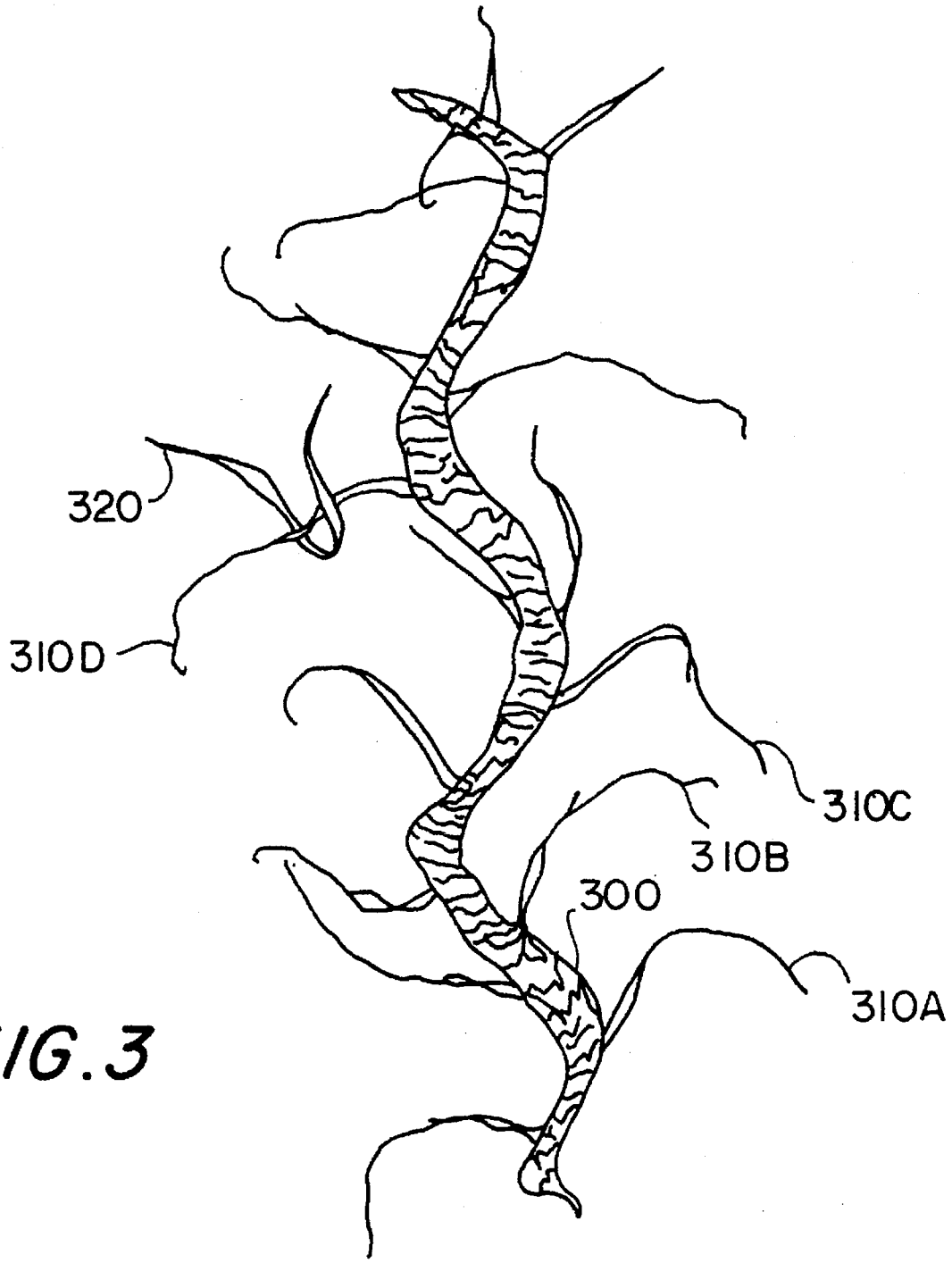
FIG. 3 is a diagram of a wool fiber.

Felt is formed by matting together fibers, rather than weaving fibers, under pressure. The fibers are preferably wool. As shown in FIG. 3, a wool fiber has a somewhat coiled spine 300 with hairs 310A, . . . , 310D extending therefrom. A hair 320 is shown as entangled with a hair 310D. The hair 310D is connected to the spine 300, whereas the hair 320 is unconnected, being previously attached to the spine 300 or to a spine of another fiber. Compressed felt chunks tend to retain all their mass when used in a finishing operation, since the chunks do not abrade each other. Thus, this is a fairly durable finishing media.

Importantly, after a hair is detached from one spine, it tends to become entangled with other hairs. Therefore, compressed felt chunks have a self-renewing action, exhibiting substantially improved durability relative to conventional finishing media. Specifically, after contacting the surface of a workpiece, hairs from a felt chunk may detach from their respective spine, but then such hairs become enmeshed with hairs from the same or another felt chunk and are available for another contact with a workpiece surface. Similarly, the spines of fibers may tangle, so that fibers lost from one chunk can become part of another chunk. In contrast, when portions of conventional finishing media separate from the main body of the media, the separated portions are waste material which are no longer usable and must be removed during the course of a finishing operation.

Figure 1:
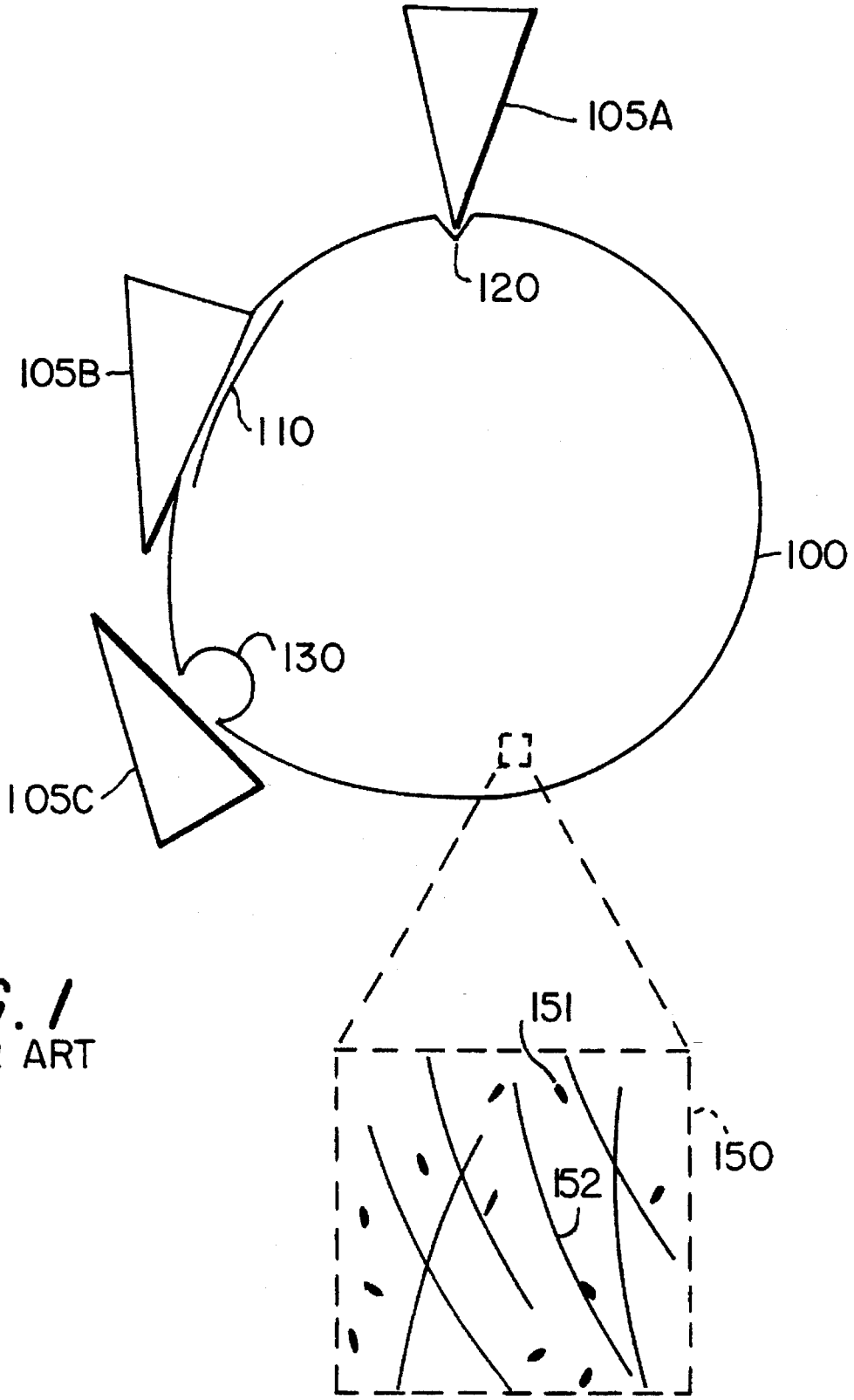
FIG. 1 PRIOR ART
FIG. 1 is a diagram illustrating surface finishing of a workpiece using conventional media.
Figure 2:
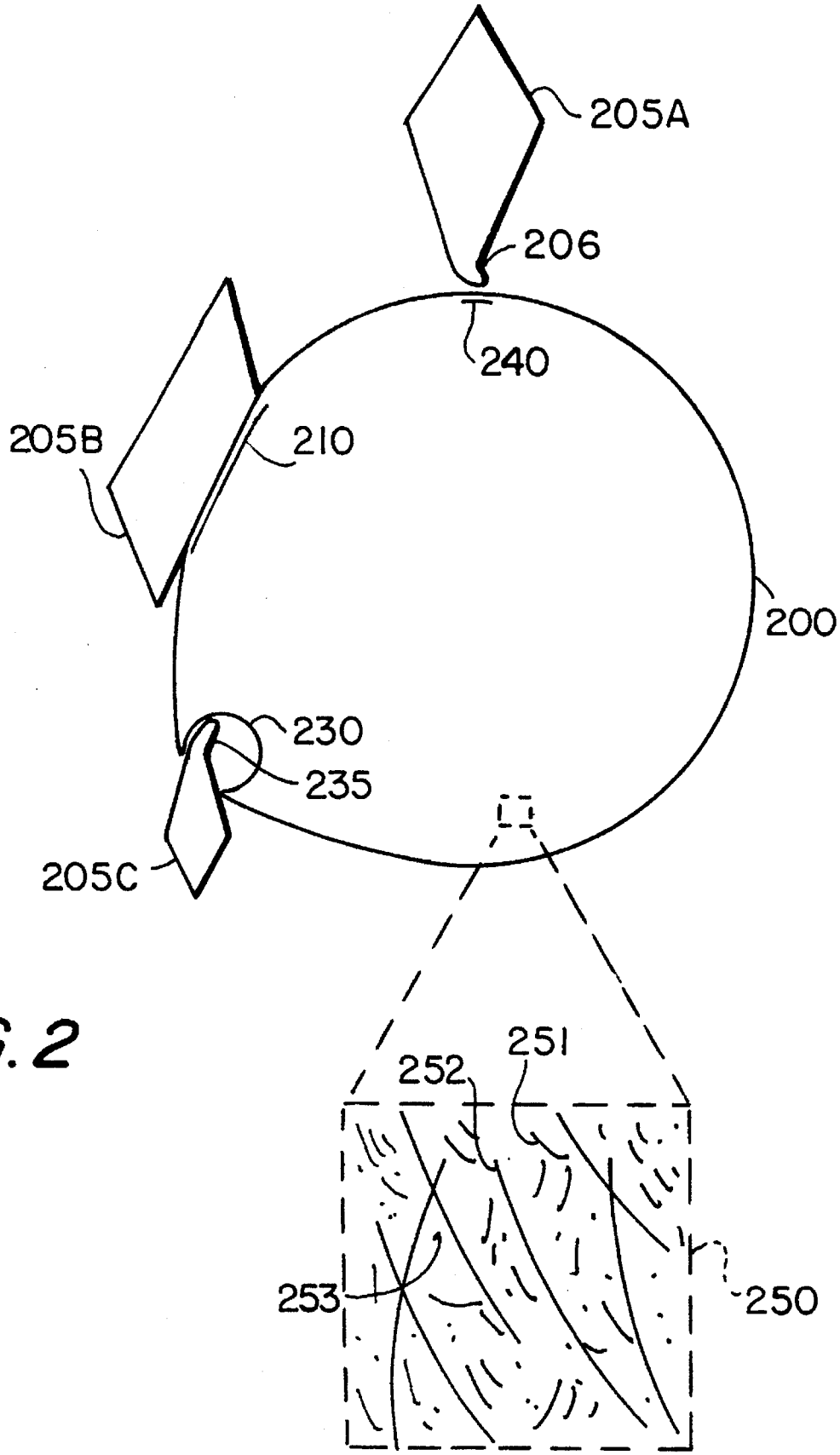
FIG. 2 is a diagram illustrating surface finishing of a workpiece using compressed felt media according to the present invention.

Compressed felt chunk 205B of FIG. 2 is seen to be sliding along the surface of workpiece 200, creating a long scratch 210, which desirably finishes the surface of workpiece 200.

The workpiece 200 has a U-shaped socket 230. A portion 235 of compressed felt chunk 205C is seen to be deforming its curvature to finish the interior surface of the socket 230. That is, the flexibility of the felt chunk allows it to conform to the surface of the workpiece, so that the abrasive carried by the felt chunk has an opportunity to finish the surface of the workpiece. Thus, complex surfaces may be satisfactorily finished using compressed felt chunks as finishing media.

During contact between abrasive coated compressed felt chunks and the surface of a workpiece, workpiece surface portions removed mainly consist of the substance formerly in the scratches removed by the abrasive embedded in the felt chunk. That is, although the workpiece surface is polished, since the felt is itself deformed, there is a cushioning effect with minimal abrasion of the workpiece surface. Consequently, compressed felt chunks are inherently non-abrasive and are good for finishing a surface without changing the contour of the surface.

When a tip 206 of felt chunk 205A contacts workpiece 200 normal to the surface thereof, the tip 206 bends during contact with the workpiece, imparting a short scratch 240 to the workpiece. A short scratch pattern results in negligible light diffraction, that is, a highly reflective, bright, apparently flawless surface finish. In contrast, conventional media dig pits in workpiece surfaces that diffract light and result in a dull finish.

The felt chunks are resilient, compressing under pressure and uncompressing when the pressure is removed. The compression and uncompression of the abrasive coated felt chunks creates very short scratches in the surfaces of workpieces, which further finishes these surfaces.

A portion 250 of the surface of workpiece 200 is shown enlarged. The surface contains short scratches 251 and long scratches 252, corresponding to the action of compressed felt chunks 205A and 205B, respectively. The surface also contains very short scratches 253 formed during compression and uncompression of the abrasive coated felt chunks.

The amount of abrasive breakdown is fairly small when using abrasive coated compressed felt chunks as finishing media, since the abrasive is substantially separated from other abrasive. There is no need to remove broken down abrasive during a finishing operation using compressed felt chunks. In contrast, the abrasive paste used with conventional finishing media promotes abrasive breakdown due to the contact of the abrasive with itself. The finishing action of abrasive coated compressed felt chunks is substantially linear with time. Also, since the abrasive size of abrasive coated compressed felt chunks remains relatively constant during finishing, it is easy to avoid use of an abrasive size range which causes surface fracturing of a workpiece. Thus, there is a reduced need for external monitoring of the finishing process, and it is easier to obtain consistent results.

The compressed felt chunks may be used in any type of automatic finishing barrel and in a wet or dry process. A surface finished with abrasive coated compressed felt chunks in a rotary barrel finisher, centrifugal barrel finisher or centrifugal disk finisher has a scratch pattern as shown in the enlarged portion 250 of FIG. 2.

If a workpiece surface is finished with abrasive coated compressed felt chunks in a vibratory barrel finisher, then it has a scratch pattern mainly comprising very short scratches, such as very short scratches 253 of FIG. 2, and is substantially devoid of longer scratches. Specifically, during a finishing operation the workpiece stays in a central portion of the mass of finishing media, rather than on or towards the outside of the mass of finishing media. Thus, although some of the finishing media at the outside of the mass exhibit rolling motion, the workpiece does not, and so it is devoid of the long scratches that occur in a conventional process.

This very short scratch pattern produces a surface with substantially better reflectivity than the surface reflectivity obtainable through any conventional process, including manual buffing. The exceptionally high reflectivity of a surface finished in this manner is perceived as an extraordinarily shiny and flawless finish.

A standard vibratory finisher provides a vibration amplitude of approximately 1/16 inch. It has been found that a vibratory finisher which provides a vibration amplitude of approximately 3/16 inch provides substantially better results for a finishing operation in which abrasive coated compressed felt chunks are used. It is believed that the relatively light weight of the felt chunks is more effectively moved by the larger vibration amplitude.

The present invention resides in a process for finishing the surfaces of objects or workpieces made of plastic, ceramic and/or metallic material. Surface roughness is measured normal to the nominal surface of a workpiece. A surface roughness of less than 1 microinch is produced using the present invention.

As described below, a multiple step operation using a centrifugal barrel finisher, a vibratory finisher, conventional finishing media and abrasive coated compressed felt chunks is possible. An important advantage of the present invention is production of a finely polished surface with minimal workpiece material removal. The multi-step nature of the present invention greatly reduces the overall workpiece finishing time. Since the use of multiple steps avoids the need to rely on abrasive breakdown, consistent and simple control of a finishing process is possible.

Many variations of this procedure are envisioned, depending upon the nature of the workpiece and its uses, and on the nature of the desired finish. For example, if a workpiece has holes or cavities, it is advisable to select the size of the finishing media so as to avoid clogging the holes or cavities. If the workpiece has threads, it is helpful to add a light coating of oil to the compressed felt chunks to encourage retention of abrasives by the felt chunks, reducing the amount of abrasive transferred to the threads of the workpiece during finishing.

Plastic parts benefit from a finishing process according to the present invention, since they are made of a soft material and often are initially produced with deep scratches that propagate fractures resulting in an undesirably crazed surface. These plastic parts are effectively finished using gentle pressure and a multitude of contacts with the abrasive coated compressed felt chunk finishing media.

The purpose of a first step is to abrade excess material from the workpieces, so rigid finishing material are used. The first step may be omitted if the workpiece is already smooth, that is, has a surface roughness of less than 20 microinches, or if the workpiece is fragile. For example, if the workpiece has voids which could become cleave points, producing surface fractures, it is preferred to go directly to a second stage using flexible finishing media, with an abrasive coating size selected in view of the void size.

In the first step, a centrifugal barrel finisher filled to 50–80% of capacity is used. Depending upon the composition and shape of the workpieces, different finishing media and a wet or dry process may be used. For a dry process, the finishing media may be grain, such as walnut or corn. For a wet process, the liquid may be water, refined mineral oil or polyalkylene glycol, and the finishing media may be plastic or ceramic, such as polystyrene or urea formaldehyde combined with zirconia, silica or aluminum oxide.

The first step improves sphericity, that is, abrades the surface of the workpieces, and reduces surface roughness of a workpiece having a surface which is machined or rough belt 120 grit or finer (65–70 microinches) to between 10–20 microinches.

In a second step, a centrifugal barrel finisher is used. In either a wet or a dry process, grain and/or abrasive coated compressed felt chunks may be used as finishing media. For a wet process, high purity mineral oil is preferred due to its inertness. A combination of grain and abrasive coated compressed felt chunks is particularly useful when finishing parts with complex or discontinuous shapes, since such a combination produces a random media motion which eliminates cavitation and preferential orientation of workpieces, and promotes uniform finishing of complex shapes.

The abrasive coating for the felt chunks may be comprised of silicon carbide, aluminum oxide, cerium oxide, or diamond of up to twice the size of the desired finish, e.g., 9 micron diamond for a 4.5 micron finish. Selection of the abrasive is performed to ensure compatibility with the nature of the workpiece, such as silicon carbide for plastic workpieces and diamond for ceramic workpieces, and its adjunctive materials, that is, materials with which it will be subsequently used, for example, reactivity to the human body.

The second step reduces surface roughness of the workpieces to less than 4 microinches.

In a third step, a vibratory barrel finisher is used. In either a wet or dry process, only abrasive coated compressed felt chunks are used as finishing media. The finishing action in this step is characterized by low pressure, high repetition contacts. Workpiece surfaces are finished by the compression and uncompression of the media.

The third step reduces surface roughness to less than 1 microinch. The surface finish has an unusually short scratch pattern.

A fourth step may also be employed to achieve an even finer finish. This fourth step advantageously uses a vibratory barrel finisher with a finishing media of abrasive coated compressed felt chunks. The abrasive may be 0.3 or 0.05 (1/20 micron) alumina.

Between finishing steps, it is preferred that any retained abrasive be cleaned from the workpieces, such as by manual, ultrasonic or detergent cleaning.

Several examples of a finishing operation according to the present invention will now be described.

In one example, ceramics such as aluminum oxide or zirconia, for example, zirconia balls for use in medical applications, received in an as machined state including lathe machine marks, may be finished in a three-step dry operation using a centrifugal barrel finisher operated at 320 or 325 rpm in each step. Due to the impingement of finishing media on ceramic, the length of the scratches in the scratch pattern is approximately ¼ of the size of the abrasive.

In a first step, compressed felt chunks coated with 30 micron diamond abrasive are used as the finishing media. The first step lasts about 1.5 hours. The function of the first step is to smooth the workpieces to a surface roughness of under 15 microinches.

In a second step, compressed felt chunks coated with 9 micron diamond cutting abrasive are used as the finishing media. The second step lasts about 1 hour. The function of the second step is to polish the workpieces to a surface roughness of less than 6 microinches.

In a third step, compressed felt chunks coated with 1 micron diamond cutting abrasive as used as the finishing media. The third step lasts about 1 to 1.5 hours. The function of the third step is to polish the workpieces to a surface roughness of less than 2 microinches.

Conventional media are not effective for polishing these ceramics, since the media are softer than the workpieces and are not an effective carrier for an abrasive. The compressed felt chunks act as a carrier for the diamond abrasive, which is harder than the workpieces and actually performs the finishing.

An advantage of using a multi-step operation is reduced processing time. For example, a one step operation using only compressed felt chunks coated with 1 micron diamond abrasive is estimated to require approximately 50 hours to achieve a surface roughness of less than 2 microinches, versus a total of about 33.5 hours for the three step operation described above.

In another example, cobalt chrome workpieces for medical applications received in a 220 belt state or coarser, that is, a surface roughness of approximately 30 microinches, may be finished in a four-step operation to achieve a surface roughness of approximately 2 microinches.

The first step is a wet process performed in a centrifugal barrel finisher operated at 120 rpm. The finishing media for this step are, for example, zirconia tetraform ⅜ inch cones. This first step takes about an hour.

The second step is a wet process performed in a centrifugal barrel finisher operated at 120 rpm. The finishing media for this step are, for example, R700 media from Rosemont Industries, Cincinnati, Ohio, a polyester resin with a quartz abrasive. This second step takes about two hours.

The third step is a dry process performed in a centrifugal barrel finisher operated at 140–160 rpm. The finishing media for this step is a mixture of grain media, compressed felt chunks coated with an abrasive of 1200 grit (9 micron) such as silicon carbide, and #169 oil. Advantageously, this mixture is about 80% compressed felt chunks and 20% grain, by volume. This third step takes about four hours.

Grain media used by itself tends to create a flow pattern on the workpiece due to uneven collisions of the media across the surface of the workpiece. That is, grain media finishes only certain portions of the surface of the workpiece and tends to produce a scratch pattern with aligned scratches. In the above-described mixture, the felt chunks serve two purposes. First, the felt chunks result in a more random scratch pattern due to dispersal of the grain media and/or jarring the workpieces during finishing. Second, the felt chunks are an efficient carrier for the abrasive which performs finishing.

The fourth step is a dry process performed in a vibratory barrel finisher providing a vibration amplitude of approximately 3/16 inch, at 1750 rpm. The finishing media for this step are compressed felt chunks coated with a 1 micron abrasive such as alumina oxide, and #169 oil. This fourth step takes about 2 to 2.5 hours.

In yet another example, cobalt chrome workpieces received with a less coarse surface, such as 300 belt, that is, a surface roughness of approximately 15 microinches, may be finished in a two-step operation to achieve a surface roughness of approximately 2 microinches.

The first step is a dry process performed in a traction drive centrifugal barrel finisher operated at about 320 rpm. This apparatus is faster than a centrifugal barrel finisher, and imparts greater energy to the finishing media contained therein. The finishing media for this step is a mixture of grain media, compressed felt chunks coated with an abrasive of 1200 grit, and #169 oil. This first step takes about 20–30 minutes.

The second step is a dry process performed in a vibratory barrel finisher providing a vibration amplitude of approximately 3/16 inch, at 1750 rpm. The finishing media for this step are compressed felt chunks coated with a 1 micron abrasive such as alumina oxide, and #169 oil. This second step takes about 2 to 2.5 hours.

In still another example, titanium workpieces for medical applications received in approximately a 220 belt state may be finished in a four-step operation to achieve a surface roughness of approximately 2 microinches.

The first step is a wet process performed in a centrifugal barrel finisher operated at 150 rpm. The finishing media for this step are, for example, zirconia tetraform 3/8 inch cones. This first step takes about an hour.

The second step is a wet process performed in a centrifugal barrel finisher operated at 150 rpm. The finishing media for this step are, for example, R700 media. This second step takes about two hours.

The third step is a dry process performed in a centrifugal barrel finisher operated at 140–160 rpm. The finishing media for this step is a mixture of grain media, compressed felt chunks coated with an abrasive of 1200 grit, and #169 oil. This third step takes about 3.5 to 4 hours.

The fourth step is a dry process performed in a vibratory barrel finisher providing a vibration amplitude of approximately 3/16 inch, at 1750 rpm. The finishing media for this step are compressed felt chunks coated with a 1 micron abrasive such as alumina oxide, and #169 oil. This fourth step takes about 3 to 6 hours.

In a further example, workpieces made of hard plastic, such as acrylic, polycarbonate or DELRIN™, may be finished in a three-step operation to achieve a surface roughness of approximately 2 microinches, or a four-step operation to achieve a surface roughness of less than 1 microinch.

The first step is a wet process performed in a vibratory barrel finisher providing a vibration amplitude of about 1/16 inch at 1650 rpm. The finishing media for this step are, for example, R700 media. This first step takes about two to six hours, and results in workpieces with a surface roughness of about 9 microinches.

The second step is a dry process performed in a vibratory barrel finisher providing a vibration amplitude of approximately 3/16 inch, at 1750 rpm. The finishing media for this step are compressed felt chunks coated with an abrasive of 1200 grit, and #169 oil. This second step takes about eight hours, and results in workpieces with a surface roughness of about 4–6 microinches.

The third step is a dry process performed in a vibratory barrel finisher providing a vibration amplitude of approximately 3/16 inch, at 1750 rpm. The finishing media for this step are compressed felt chunks coated with a 1 micron abrasive such as alumina oxide, and #169 oil. This third step takes about four to six hours, and results in workpieces with a surface roughness of about two microinches.

The fourth step is a dry process performed in a vibratory barrel finisher providing a vibration amplitude of approximately 3/16 inch, at 1750 rpm. The finishing media for this step are compressed felt chunks coated with a 0.05 micron abrasive such as alumina, and #169 oil. This fourth step takes about eight hours, and results in workpieces with a surface roughness of under one microinch.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A method for finishing a surface of a workpiece, comprising the steps of:

first agitating said workpiece with a first mixture including a first plurality of discrete, homogeneous compressed felt chunks having a first particulate abrasive coating thereon; and second agitating said workpiece with a second mixture including a second plurality of discrete, homogeneous compressed felt chunks having a second particulate abrasive coating thereon, said second particulate abrasive coating having an abrasive size smaller than an abrasive size of said first particulate abrasive coating.

2. The method of claim 1, further comprising a step of third agitating said workpiece with a third mixture before said step of first agitating.

3. The method of claim 1, further comprising a step of fourth agitating said workpiece with a fourth mixture including an additional plurality of discrete, homogeneous compressed felt chunks having a fourth particulate abrasive coating thereon, said fourth particulate abrasive coating having an abrasive size smaller than the abrasive size of said second particulate abrasive coating.

4. The method of claim 1, wherein said step of second agitating occurs in a vibratory barrel finisher.

5. The method of claim 4, wherein said vibratory barrel finisher provides a vibration amplitude of approximately 3/16 inch.

6. The method of claim 1, wherein said first mixture also includes grain media.

7. An article having a finished surface, said surface being finished by the steps of:

first agitating said article with a first mixture including a first plurality of discrete, homogeneous compressed felt chunks having a first particulate abrasive coating thereon; and second agitating said article with a second mixture including a second plurality of discrete, homogeneous compressed felt chunks having a second particulate abrasive coating thereon, said second particulate abrasive coating having an abrasive size smaller than an abrasive size of said first particulate abrasive coating.

* * * * *